US010111483B2

(12) United States Patent
McGuffog

(10) Patent No.: US 10,111,483 B2
(45) Date of Patent: Oct. 30, 2018

(54) SUN PROTECTIVE HEADWARE SYSTEM

(71) Applicant: Roni McGuffog, Plainview, NY (US)

(72) Inventor: Roni McGuffog, Plainview, NY (US)

( * ) Notice: Subject to any disclaimer, the term of this patent is extended or adjusted under 35 U.S.C. 154(b) by 285 days.

(21) Appl. No.: 15/085,064

(22) Filed: Mar. 30, 2016

(65) Prior Publication Data

US 2016/0309825 A1 Oct. 27, 2016

Related U.S. Application Data

(60) Provisional application No. 62/151,683, filed on Apr. 23, 2015.

(51) Int. Cl.

| | |
|---|---|
| ***A42B 1/22*** | (2006.01) |
| ***A42B 1/06*** | (2006.01) |
| ***A42B 1/20*** | (2006.01) |

(52) U.S. Cl.

CPC ..... *A42B 1/069* (2013.01); *A42B 1/201* (2013.01); *A42B 1/22* (2013.01)

(58) Field of Classification Search

CPC ..... A42B 1/02; A42B 3/322; A42B 1/247; A42B 1/205; A42B 1/201; A42B 1/22

See application file for complete search history.

(56) References Cited

U.S. PATENT DOCUMENTS

| | | | | |
|---|---|---|---|---|
| 1,479,670 | A * | 1/1924 | McKnight | A42B 1/069 2/181 |
| 6,484,323 | B1 * | 11/2002 | Pu | A42B 1/201 2/10 |
| 8,533,869 | B1 * | 9/2013 | Capuano | A42B 3/12 2/171 |
| 8,550,099 | B2 * | 10/2013 | Essex | A42B 1/18 135/16 |
| 2001/0025385 | A1 * | 10/2001 | Montague | A42B 1/02 2/175.2 |
| 2012/0210491 | A1 * | 8/2012 | Bryan | A42B 3/227 2/181.4 |

* cited by examiner

*Primary Examiner* — Tejash Patel
(74) *Attorney, Agent, or Firm* — Dunlap Bennett & Ludwig PLLC

(57) ABSTRACT

A sun protective headwear system is provided. The sun protective headwear system may include a headwear having a body and brim portion with a novel sun protective inner lining. The inner lining may incorporate recycled water bottles to achieve advantageous sun protective properties. A closure mechanism may be provided along a rear body portion, near a tensive brim seam joining the brim portion to the body portion, so that in a closed condition the closure mechanism maintains the shape of the headwear while adjusting its fitting so as to be suitable across a wide range of head sizes. The sun protective headwear system may also include a packable pouch dimensioned and adapted to be crushably folded when the packable pouch houses the headwear.

8 Claims, 8 Drawing Sheets

SUN PROTECTIVE HEADWARE SYSTEM

CROSS-REFERENCE TO RELATED APPLICATION

This application claims the benefit of priority of U.S. provisional application No. 62/151,683, filed 23 Apr. 2015, the contents of which are herein incorporated by reference.

BACKGROUND OF THE INVENTION

The present invention relates to sun protective headwear and, more particularly, a sun protective headwear with recycled plastic bottle fabric lining and a closure mechanism to maintain its shape while enabling the sun protective headwear to fit a wide range of head sizes.

Typically, when planning to spend time in the sun, one needs a sun protective hat. However, such hats currently do not have sufficient lining to provide strong sun protection. Moreover, current sun hats provide closure mechanisms, such as drawstrings, that unflatteringly modify the shape of the hat. Furthermore, though current sun hats may provide a mechanism, such as a drawstring, for adjusting the sun hat to fit a wide range of head sizes, such mechanisms typically distort the shape of the sun hat, producing a displeasing scrunched shaped hat.

As can be seen, there is a need for a sun protective headwear system including headwear having a novel inner sun protective lining and a closure mechanism enabling adjustability for a wide range of head sizes, yet adapted to maintain the shape of the headwear through the wide ranges of adjusted sizes.

SUMMARY OF THE INVENTION

In one aspect of the present invention, a sun protective system including a headwear including a semi-cylindrical body portion, wherein the body portion defines a head opening adapted to receive an upper portion of a human wearer, wherein the head opening communicates to a body inner portion of the headwear; and a first layer disposed along the body inner portion, wherein the first layer comprises recycled water bottles.

In another aspect of the present invention, the headwear includes a brim portion disposed about a periphery of the head opening, wherein the first layer is disposed along a brim inner portion of the brim portion; a second layer connected to the first layer; a closing mechanism comprising a male fastener aligned to a plurality of spaced apart female fasteners, wherein the closing mechanism is disposed along the second layer of the body portion, and wherein the male fastener is offset from the plurality of female fasteners an offset distance that is greater than a distance between each of the plurality of female fasteners.

In yet another aspect of the present invention, the sun protective system includes a packable pouch dimensioned and adapted to crushably fold when the packable pouch houses the device in a folded condition, wherein the packable pouch provides pouch drawstrings for sealing the packable pouch, and wherein the pouch drawstrings is a removable fastener.

These and other features, aspects and advantages of the present invention will become better understood with reference to the following drawings, description and claims.

DETAILED DESCRIPTION OF THE INVENTION

Figure 1:
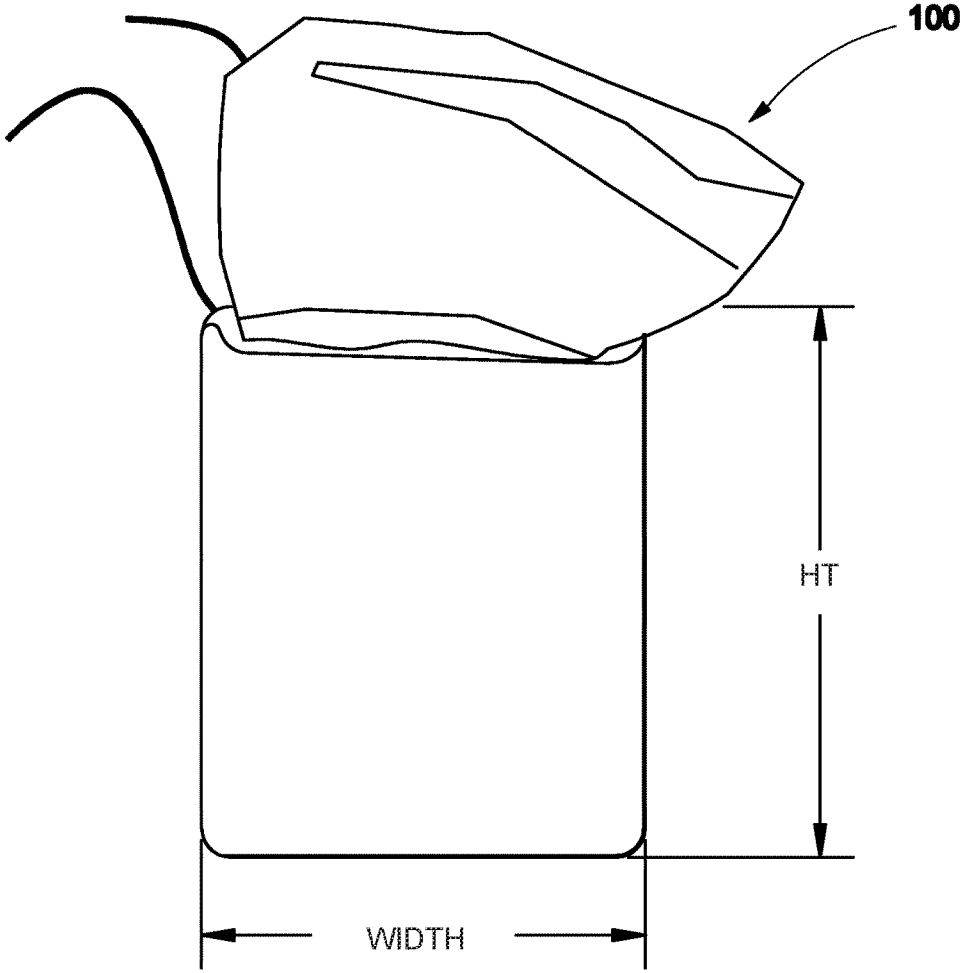
FIG. 1 is an elevation view of an exemplary embodiment of the present invention.
Figure 2:
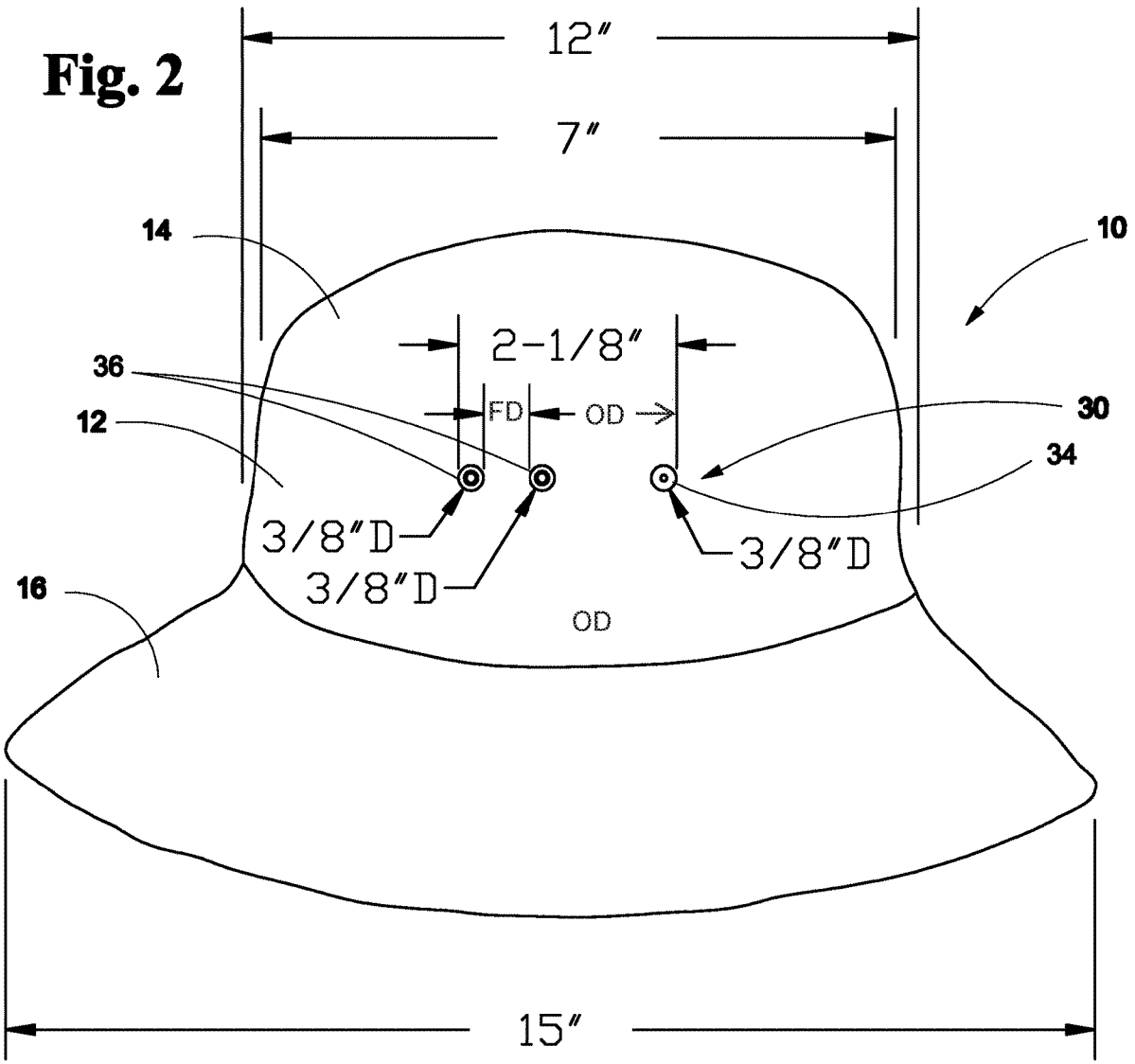
FIG. 2 is an elevational view of an exemplary embodiment of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a sun protective headwear system. The sun protective headwear system may include a headwear with a novel sun protective inner lining and a closure mechanism to maintain the shape of the headwear while adjusting its fitting so as to be suitable across a wide range of head sizes. The sun protective headwear system may also include a packable pouch dimensioned and adapted to be crushably folded when the packable pouch houses the headwear.

Referring now to FIGS. 1 through 8, the present invention may include a sun protective system 100. The sun protective system 100 may include a headwear 10 having a closure mechanism 30 for maintaining the shape of the headwear 10 while adjusting the fitting so as to be suitable across a wide range of head sizes. The sun protective system 100 may include a packable pouch 40 for storing the headwear 10.

The headwear 10 may include a body portion 12, interconnecting a top portion 14 and a brim portion 16, wherein the brim portion 16 and the body portion 12 are joined along a brim seam 15. Generally speaking, the body portion 12 may be formed in a cylindrical shape defining a circular head opening 26 for receiving the top of a wearer's head, and so the body portion 12 may be generally defined by a "circumference." In certain embodiments, the cylindrical shape of the body portion 12 may taper as it extends from the brim portion 16 to the top portion 14. The headwear 10 may form any shape, so long as the shape enables the functionality in accordance with the present invention as described herein.

The headwear 10 may include a first lining 20 and a second lining 22. The first lining 20 may be a fabric made of, at least in part, recycled water bottles, it being discovered that fabric incorporating sufficient percentages of recycled water bottles provides at least 99.85% UVB and 99.85% UVA rating. In certain embodiments, the first lining 20 may incorporate recycled water bottles and outdoor furniture fabric, such as outdoor umbrella fabric. In a certain embodiment, the first lining 20 may include outdoor umbrella fabric. In certain embodiments, the first lining 20 may be any lightweight UPF/UV resistant poly fabric or suitably sun-protective material having at least a 99.85% UVB rating and a 99.85% UVA rating, and ranging up to 99.98% UVB and UVA ratings. It should be understood that many other sun protective fabrics falsely claim a 100% UVA/UVB rating, but have all tested significant lower in terms of the actual UVA/UVB protection. In any event, the first lining 20 is adapted to enable the wearer to avoid direct sunlight so they can avoid skin cancer, sun damage, age/brown spots, wrinkles, and the like. To wit, the first layer 20 and the fabrics thereof were tested at Suncare Research Laboratories, LLC in North Carolina, going through rigorous testing for the high effective UVA/UVB rating as required from The Skin cancer Foundation in New York.

The second lining 22 may include a decorative lining, such as a denim fabric, cotton fabric or other suitable fabric which enable decorative designs, prints or the like to be incorporated thereon. The first lining 20 would be the "interior" lining unto which the second (decorative "exterior") lining 22 would be attached to so as to form the shape of the headwear 10, the first lining 20 being the lining most in contact with the wearer's head.

Figure 3:
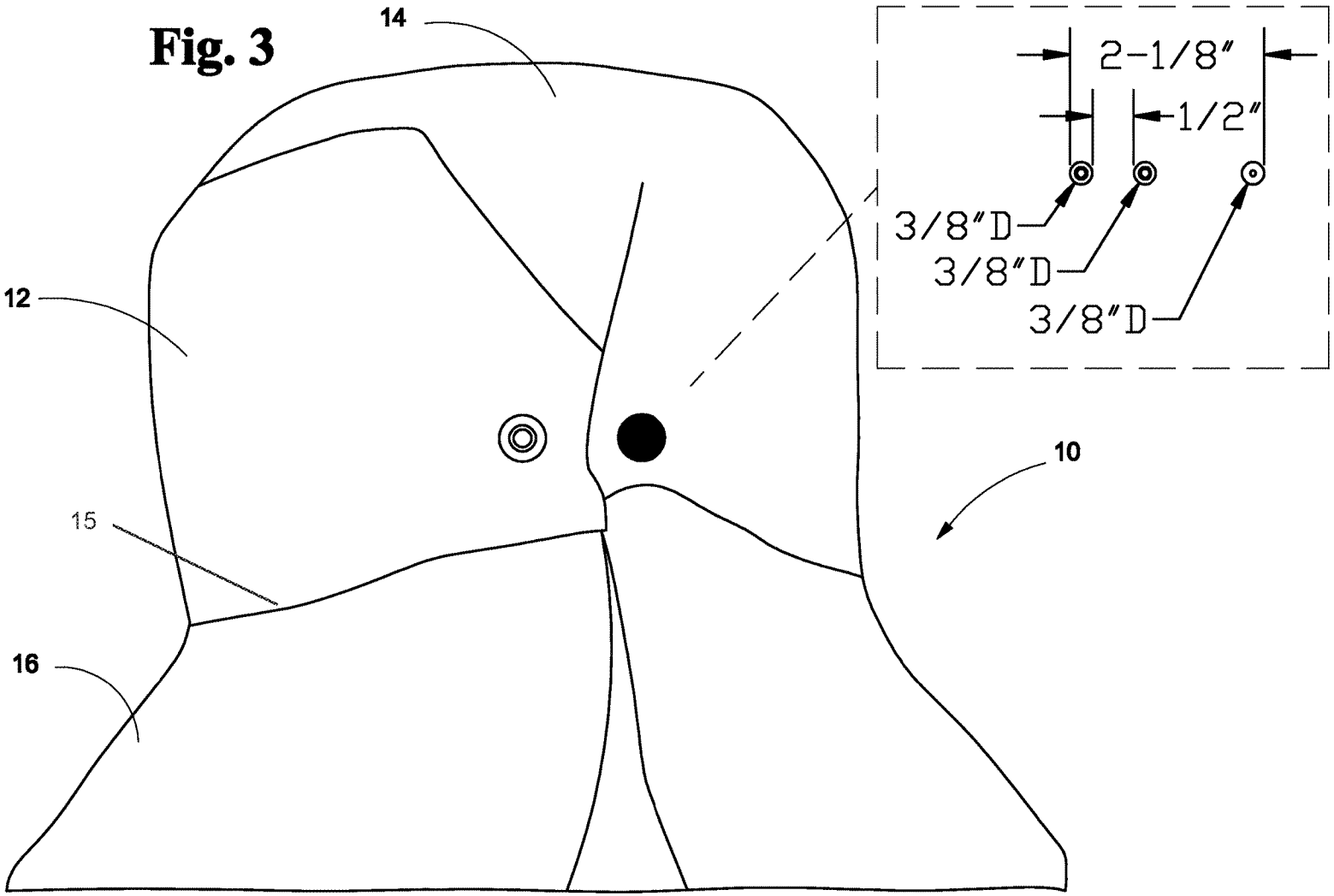
FIG. 3 is an elevational view of an exemplary embodiment of the present invention, shown in use.
Figure 5:
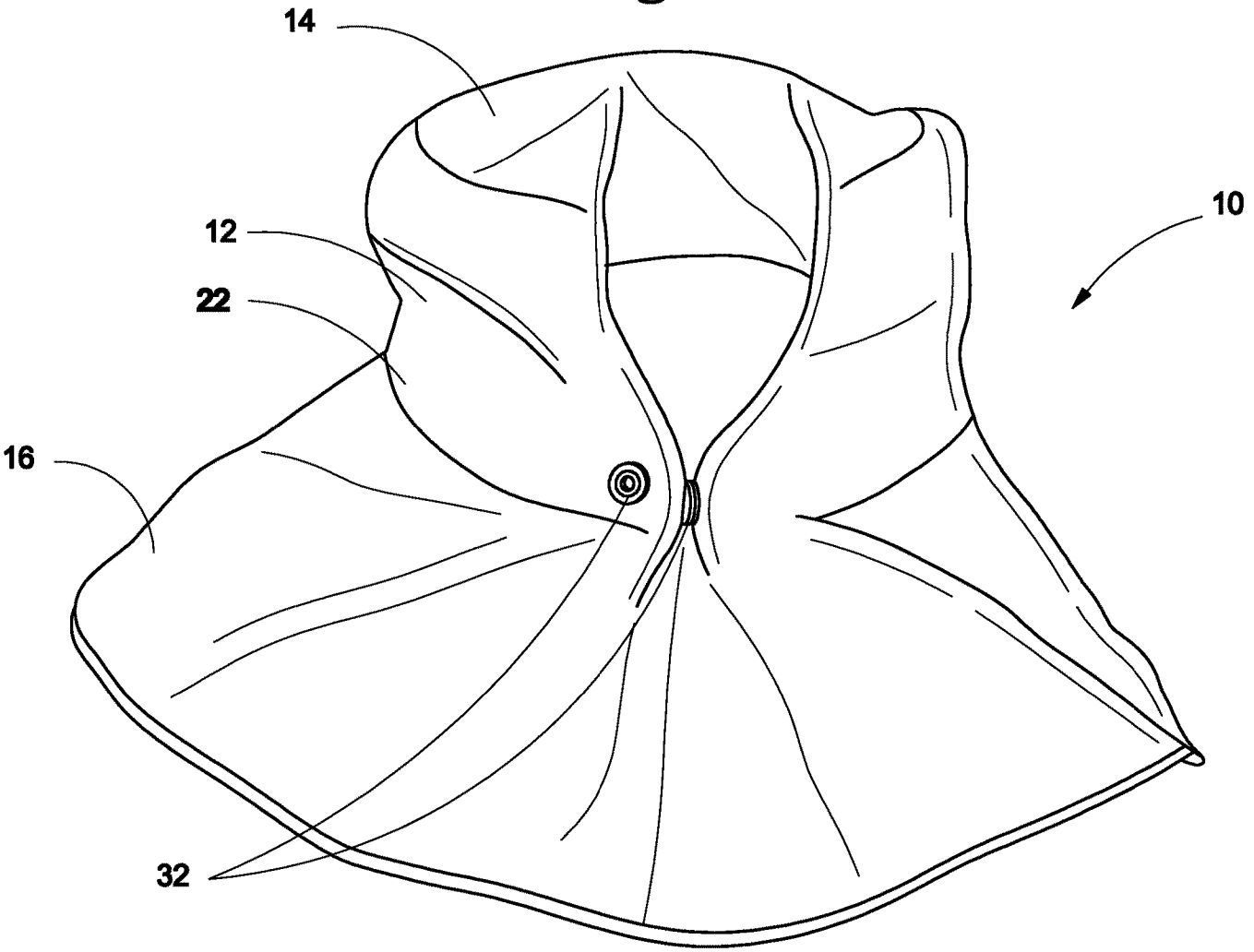
FIG. 5 is a perspective view of an exemplary embodiment of the present invention, shown use.
Figure 6:
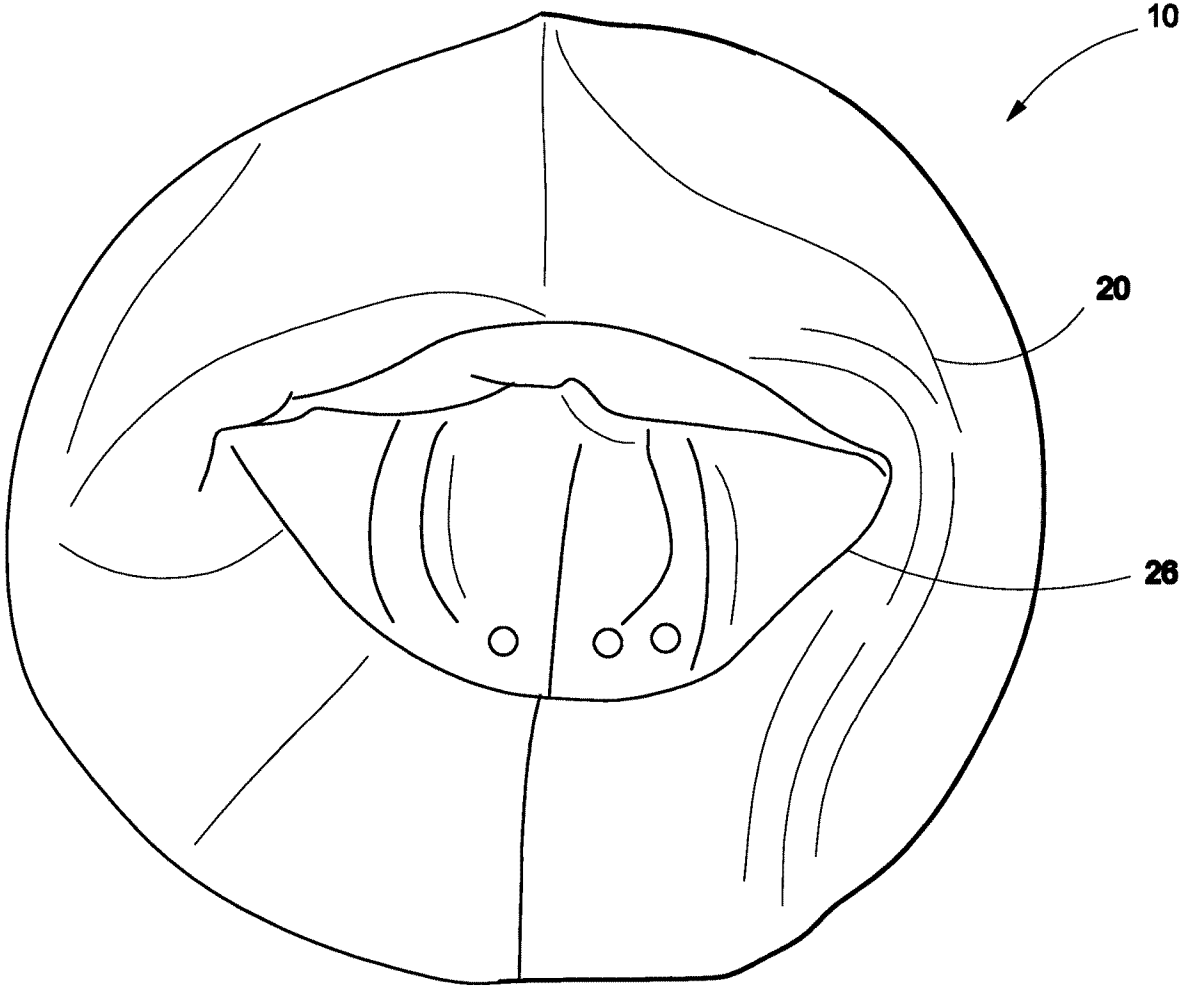
FIG. 6 is a bottom view of an exemplary embodiment of the present invention.
Figure 7:
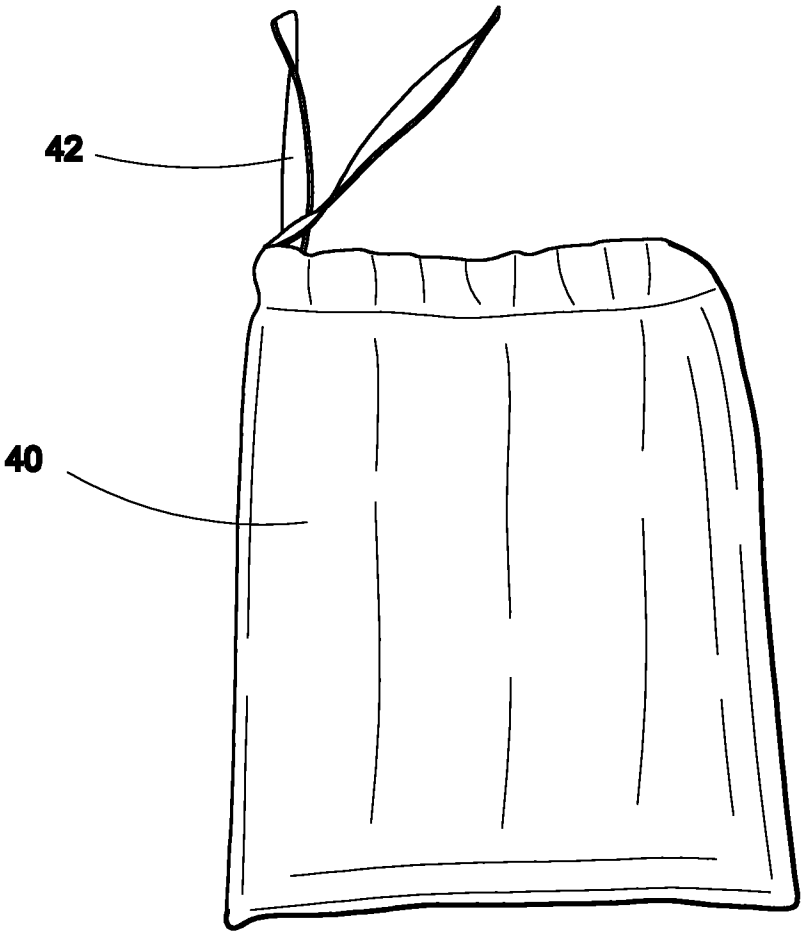
FIG. 7 is an elevational view of an exemplary embodiment of the present invention, shown in a stored condition.

The closures mechanism 30 may be disposed along the body portion 12, in certain embodiments, along a rear body portion of the body portion 12 so as not to be visible from a front side of the human wearer. The closures mechanism 30 may include a plurality of fasteners 32 including one male fastener 34 offset from a plurality of female fasteners 36, whereby the plurality of fasteners 32 are adapted to detachably connect to each other. In certain embodiments, the male 34 and the plurality of female fasteners 36 may be aligned in a single row, so that a user can connect the male fastener 34 to a predetermined female fastener 36, adjustably decreasing the circumference of the body portion 12, as illustrated in FIGS. 3 and 5. The closure mechanism 30 may be disposed between the between the top portion 14 and the brim portion 16, ranging from generally midpoint between the top and brim portions to nearer the brim portion 16 than the top portion 14. As a result of the disposition of the closure mechanism 30 relative to the tensive brim seam 15, the user may tighten and secure the headwear 10 to the top of a wearer's head by using the closure mechanism 30, making the headwear 10 adaptable to various head sizes, and in each case maintaining the shape of the headwear 10, as illustrated in FIGS. 3 and 5. FIGS. 3 and 5 demonstrate how the layers of the body portion 12 orderly fold onto themselves in a closed condition so as to maintain the generally cylindrical shape ("circumference") of the body portion 12, which enables the brim portion 16 and its protective first layer 20 to maintain its coverage of the wearer.

It should be understood that the plurality of fasteners 32 may be any fastener known in the art for fastening or removably securing one object to another including, for example, hook and loop type fasteners, adhesive substances, combinations thereof, and the like. It should also be understood that the plurality of fasteners 32 may be configured in any array and/or number, so long as the plurality of fasteners 32 function in accordance with the present invention as described herein.

Figure 4:
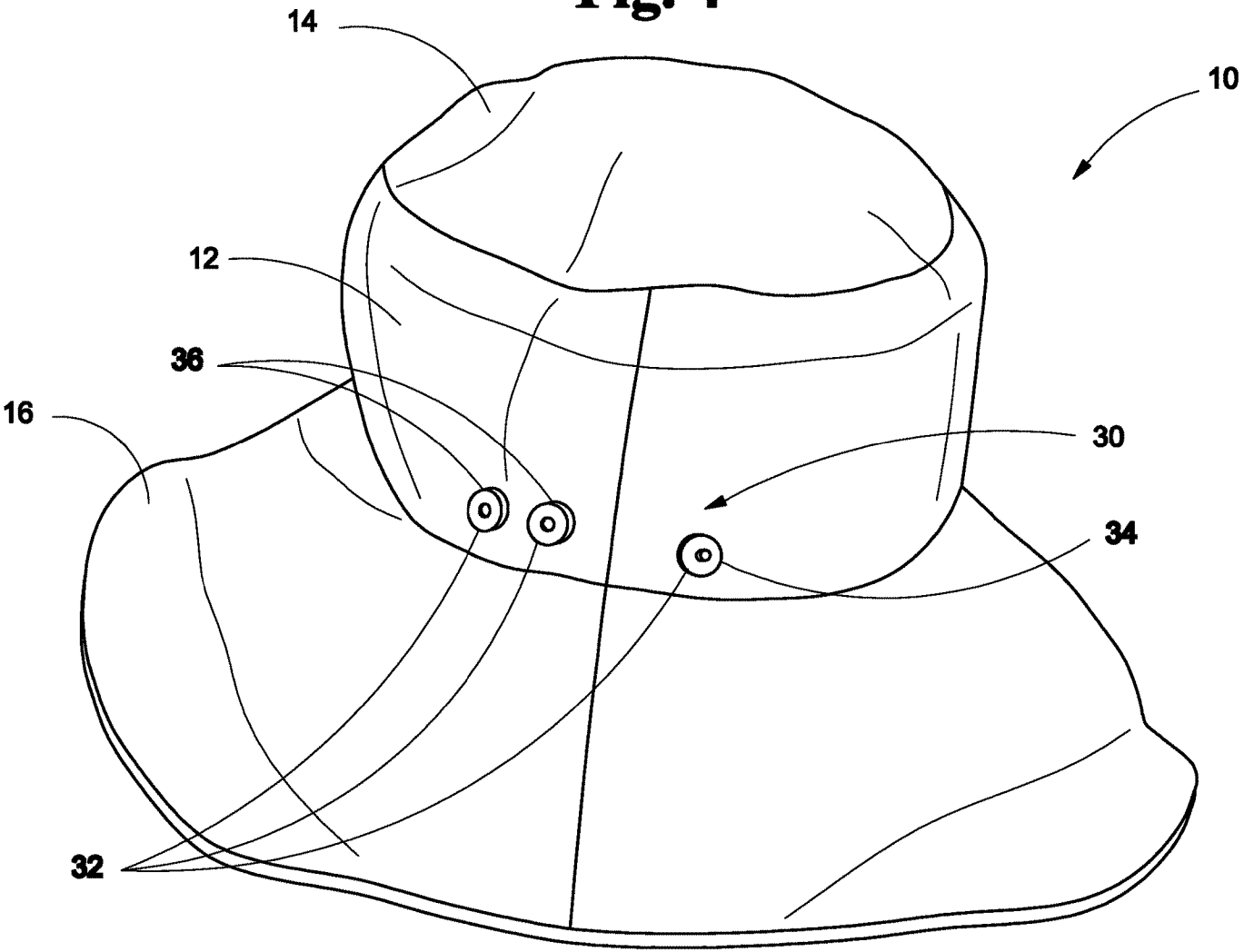
FIG. 4 is a perspective view of an exemplary embodiment of the present invention.
Figure 8:
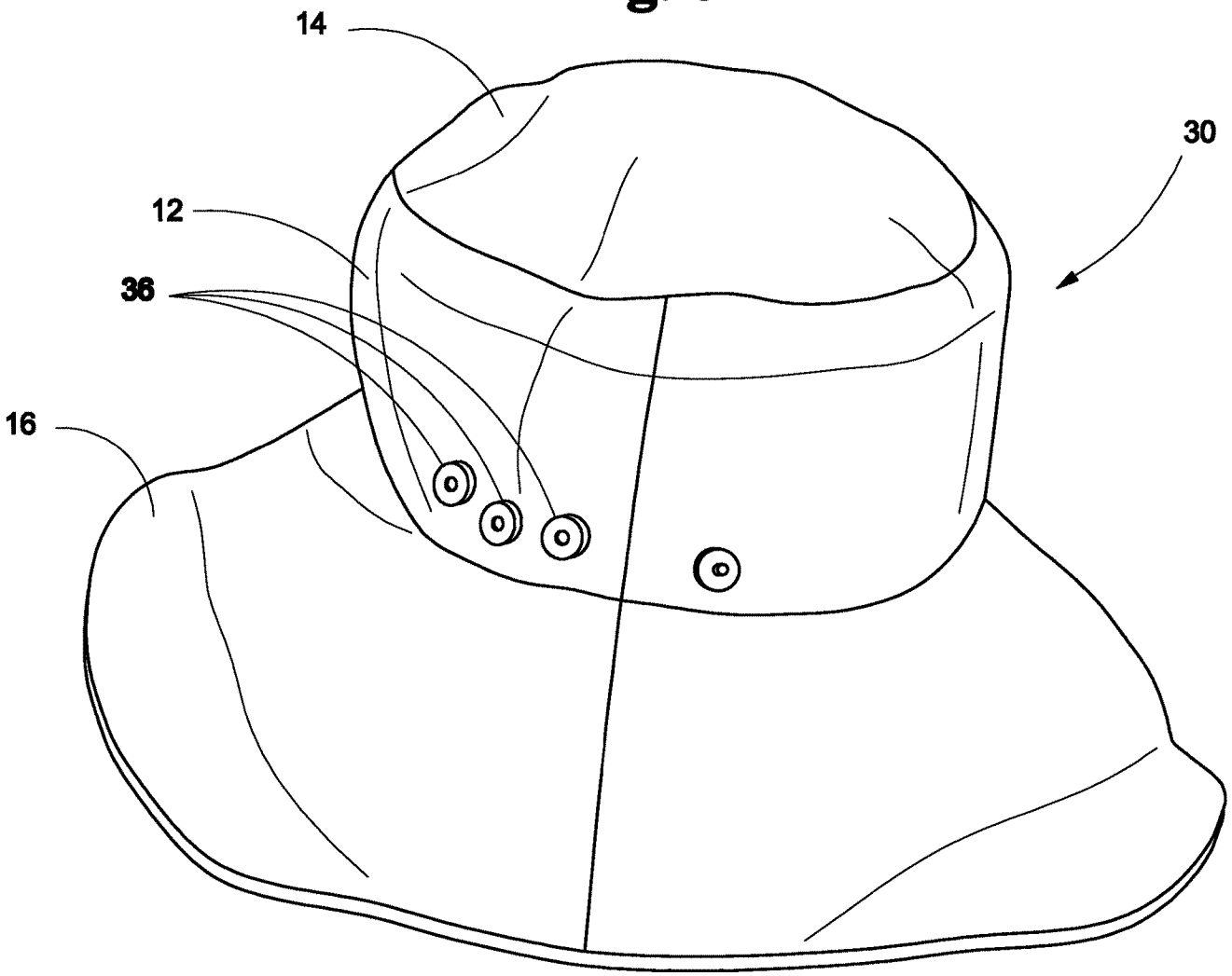
FIG. 8 is a top perspective view of an exemplary embodiment of the present invention.

In a certain embodiment, the plurality of fasteners 32 include standard push-button snaps, with two or three female fasteners 36, as illustrated in FIGS. 4 and 8, respectively. Moreover, each female fastener 36 may be spaced apart by a first distance FD. In certain embodiments, the first distance FD may be about ½ inches. There may be an offset distance OD between to the male fastener 34 and the nearest female fastener 36. The offset distance OD may be between 125% and 300% greater than the first distance FD.

The packable pouch 40 may provide a pouch opening communicating to a pouch pocket for receiving the headwear 10 in a folded condition, as illustrated in FIG. 1. The headwear 10 and the packable pouch 40 may be complementarily dimensioned and adapted to be crushably folded when the pouch 40 houses the headwear 10. The packable pouch 40 may be elongated having a height (HT) greater than its width (WIDTH), as illustrated in FIG. 1, so as to enable the crushing foldability. Pouch drawstrings 42 may be disposed about the pouch opening for detachably securing its closure. The pouch drawstrings 42 may also be an attachable fastener for removably connecting the packable pouch 40 to a wrist, bike handles, pocketbook, glove compartment, and the like so as to never leave home without the packable pouch 40 and its contents: the headwear 10.

A method of using the present invention may include the following. The sun protective system 100 disclosed above may be provided. A user may don the headwear 10 via the head opening 26. Then the user may tighten the headwear about their head by engaging the male fastener 34 and a predetermined female fastener 36 for a snug fit, while maintaining the shape of the headwear 10. Subsequent use, the user may fold the headwear 10 into the packable pouch, and then attach the drawstrings 42 to an object so that the user will never leave home without the packable pouch 40 and thus the headwear 10.

It should be understood, of course, that the foregoing relates to exemplary embodiments of the invention and that modifications may be made without departing from the spirit and scope of the present invention.

What is claimed is:

1. A device, comprising:

a headwear including a semi-cylindrical body portion, wherein the body portion defines a head opening adapted to receive an upper portion of a head of a human wearer, wherein the head opening communicates to a body inner portion of the headwear;

a first layer disposed along the body inner portion, wherein the first layer comprises recycled water bottles;

a brim portion disposed about a periphery of the head opening, wherein the first layer is disposed along a brim inner portion of the brim portion;

a second layer of material connected to the first layer; and a closing mechanism comprising a male fastener aligned to a plurality of spaced apart female fasteners, wherein the closing mechanism is disposed along the second layer of the body portion.

2. The device of claim 1, wherein the male fastener is offset from the plurality of female fasteners an offset distance that is greater than a distance between each of the plurality of female fasteners.

3. A system comprising the device of claim 2, and further comprising a packable pouch dimensioned and adapted to crushably fold when the packable pouch houses the device in a folded condition.

4. The system of claim 3, wherein the packable pouch provides pouch drawstrings for sealing the packable pouch, and wherein the pouch drawstrings is a removable fastener.

5. The device of claim 1, wherein the first layer further comprises outdoor furniture fabric.

6. The device of claim 1, wherein the second layer comprises outdoor furniture fabric.

7. The device of claim 2, wherein the body portion provides a rear body portion adapted to receive a rear portion of the head of the human wearer, and wherein the closure mechanism is disposed along the rear body portion.

8. The device of claim 7, wherein the closure mechanism is disposed near a tensive brim seam joining the brim portion and the body portion.

* * * * *